US008708034B2

(12) United States Patent
Saito et al.

(10) Patent No.: US 8,708,034 B2
(45) Date of Patent: Apr. 29, 2014

(54) AIR CONDITIONER

(75) Inventors: Tadashi Saito, Chiyoda-ku (JP); Hisashi Ueno, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 745 days.

(21) Appl. No.: 12/509,564

(22) Filed: Jul. 27, 2009

(65) Prior Publication Data

US 2010/0116461 A1 May 13, 2010

(30) Foreign Application Priority Data

Nov. 10, 2008 (JP) ..... 2008-287476

(51) Int. Cl.

| | |
|---|---|
| ***F28F 19/02*** | (2006.01) |
| ***F28F 19/00*** | (2006.01) |
| ***F28F 13/00*** | (2006.01) |
| ***F28D 1/00*** | (2006.01) |
| ***F28F 7/00*** | (2006.01) |

(52) U.S. Cl.

USPC ..... 165/133; 165/134.1; 165/135; 165/913; 165/76; 165/150; 165/905

(58) Field of Classification Search

USPC ..... 62/285, 288, 259.1, 324.62, 498, 324.6; 165/133, 134.1, 180

See application file for complete search history.

(56) References Cited

U.S. PATENT DOCUMENTS

| | | | | |
|---|---|---|---|---|
| 4,171,622 | A * | 10/1979 | Yamaguchi et al. | 62/160 |
| 4,756,358 | A * | 7/1988 | O'Neal | 165/64 |
| 4,888,218 | A | 12/1989 | Suzuki et al. | |
| 5,054,549 | A * | 10/1991 | Nakaguro | 165/133 |
| 5,269,373 | A * | 12/1993 | Sagawa et al. | 165/149 |
| 7,121,106 | B2 * | 10/2006 | Jung et al. | 62/324.6 |
| 2005/0034471 | A1 * | 2/2005 | Shin | 62/285 |
| 2005/0282033 | A1 * | 12/2005 | Nakamaru et al. | 428/623 |
| 2007/0017243 | A1 * | 1/2007 | Kidwell et al. | 62/260 |

(Continued)

FOREIGN PATENT DOCUMENTS

| | | |
|---|---|---|
| CN | 1406328 A | 3/2003 |
| CN | 1542326 A | 11/2004 |

(Continued)

OTHER PUBLICATIONS

Office Action dated Aug. 17, 2010, issued in the corresponding Japanese Patent Application No. 2008-287476, and an English Translation thereof.

(Continued)

*Primary Examiner* — Allana Lewin
*Assistant Examiner* — Dawit Muluneh
(74) *Attorney, Agent, or Firm* — Buchanan Ingersoll Rooney PC

(57) ABSTRACT

Disclosed is an air conditioner for attempting to improve on the corrosion of the outdoor unit. The air conditioner of the present invention for performing a cooling operation and a heating operation by switching a four side valve, that includes an outdoor side heat exchanger operating as a condenser during the cooling operation and an evaporator during the heating operation, and having fins and heat transfer tubes, wherein the outdoor side heat exchanger is placed on a baseboard which configures a lower portion of a chassis of the outdoor unit, comprises the fins and the heat transfer tubes of the outdoor side heat exchanger that are constructed with aluminum or aluminum alloy, and the baseboard that is constructed with Zn—Al plated steel board or Zn—Al—Mg plated steel board.

10 Claims, 11 Drawing Sheets h1: DISTANCE BETWEEN UPPER END FACE OF FINS 3-1b AND CENTER OF UPPERMOST HEAT TRANSFER TUBE 3-2 h2: DISTANCE BETWEEN LOWER END FACE OF FINS 3-1a AND CENTER OF LOWERMOST HEAT TRANSFER TUBE 3-2

(56) References Cited

U.S. PATENT DOCUMENTS

| | | | | |
|---|---|---|---|---|
| 2007/0081864 | A1* | 4/2007 | Iwasaki et al. | 405/259.3 |
| 2007/0089868 | A1* | 4/2007 | Houfuku et al. | 165/133 |
| 2007/0215333 | A1* | 9/2007 | Viklund et al. | 165/172 |
| 2007/0240864 | A1* | 10/2007 | Yabu et al. | 165/150 |
| 2008/0251742 | A1* | 10/2008 | Ise et al. | 251/11 |
| 2008/0257533 | A1* | 10/2008 | Rottmann | 165/133 |
| 2009/0107161 | A1* | 4/2009 | Jang et al. | 62/259.1 |
| 2009/0260794 | A1 | 10/2009 | Minami et al. | |

FOREIGN PATENT DOCUMENTS

| | | | |
|---|---|---|---|
| CN | 1914475 | A | 2/2007 |
| CN | 1934392 | A | 3/2007 |
| CN | 101226021 | A | 7/2008 |
| FR | 2 874 420 | A1 | 2/2006 |
| FR | 2 909 164 | A1 | 5/2008 |
| JP | 57-160595 | | 10/1982 |
| JP | 59-205467 | | 11/1984 |
| JP | 61-103673 | | 5/1986 |
| JP | 61-103674 | | 5/1986 |
| JP | 61-265497 | | 11/1986 |
| JP | 63-140766 | | 6/1988 |
| JP | 4-371734 | A | 12/1992 |
| JP | 06-341680 | | 12/1994 |
| JP | 08-313112 | | 11/1996 |
| JP | 10-281690 | | 10/1998 |
| JP | 11-337117 | | 12/1999 |
| JP | 2000-169925 | A | 6/2000 |
| JP | 2001-064461 | | 3/2001 |
| JP | 2002-187987 | | 7/2002 |
| JP | 2003-065564 | A | 3/2003 |
| JP | 2003-171779 | | 6/2003 |
| JP | 2004-069161 | A | 3/2004 |
| JP | 2004-69161 | A | 3/2004 |
| JP | 2004-69161 | A | 3/2004 |
| JP | 2005-90761 | A | 4/2005 |
| JP | 3702870 | B2 | 7/2005 |
| JP | 2008-128569 | A | 6/2008 |
| JP | 2008-202889 | | 9/2008 |
| WO | WO 01/65184 | A2 | 9/2001 |

OTHER PUBLICATIONS

Office Action (Notice of Rejection) dated Mar. 15, 2011, issued in the corresponding Japanese Patent Application No. 2008-287476, and an English Translation thereof.

Second Office Action issued on Dec. 13, 2012 by the Chinese Patent Office in corresponding Chinese Patent Application No. 2009101601917, and a partial English translation thereof.

Chinese Office Action dated Mar. 28, 2012, issued in corresponding Chinese Application No. 200910160191.7, and a partial English translation thereof (11 pages).

Third Office Action issued on Jun. 9, 2013 in corresponding Chinese Patent Application No. 2009101601917, and a partial English translation thereof.

Office Action (Final Rejection and Decision of Dismissal of Amendment) dated Dec. 20, 2011, issued in the corresponding Japanese Patent Application No. 2008-287476, and a partial English Translation thereof. (6 pages).

Extended Search Report from European Patent Office issued in corresponding European Patent Application No. 09166734.5 dated Nov. 12, 2010.

Fourth Office Action issued on Nov. 25, 2013 in corresponding Chinese Patent Application No. 2009101601917, and a partial English translation thereof.

* cited by examiner h1: DISTANCE BETWEEN UPPER END FACE OF FINS 3-1b AND CENTER OF UPPERMOST HEAT TRANSFER TUBE 3-2 h2: DISTANCE BETWEEN LOWER END FACE OF FINS 3-1a AND CENTER OF LOWERMOST HEAT TRANSFER TUBE 3-2

AIR CONDITIONER

BACKGROUND OF THE INVENTION

1. Field of the Invention

The present invention relates to an air conditioner, especially, it relates to a material used for forming a heat exchanger and a baseboard of an outdoor unit.

2. Description of the Related Art

An outer chassis of the outdoor unit of a conventional air conditioner should be coated for maintaining a corrosion resistance property and protecting a design. In addition to that, when manufacturing the outer chassis, before pressing, there is a need for performing an anti-corrosive process and an oiling process for a steel board being used as the material. There is an issue of necessity of the extra process of washing the anti-corrosive agent and the oil, after finishing the sheet metal processing, and before coating it.

Moreover, since the outer chassis of the outdoor unit of the conventional air conditioner is coated after the pressing and welding, it faces a problem of rust occurrence from a portion out of reach by a coating material.

Further, the outer chassis of the outdoor unit of the conventional air conditioner has the following problem. That is, it was impossible to implement the resistance spot welding on a pre-coated steel board in case of pressing the pre-coated steel board, because an electrical property of the pre-coated steel board deteriorates prominently.

Furthermore, when a sunlight directly hits the outer chassis of the outdoor unit of the conventional air conditioner, an interior of the outdoor unit becomes high in temperature due to a poor light reflectance of the outer chassis, so it faces a problem of reduction in the efficiency of the cooling operation.

The patent document 1 discusses an outer casing of the outdoor unit of the air conditioner that can maintain an excellent corrosion resistance property and protect the design equal or superior to the conventional air conditioner without coating. The outer chassis of the outdoor unit of the air conditioner comprises a casing manufactured without the coating for storing the mechanical and electrical components of the air conditioner, and a highly durable alloy plated steel that is coated by resin of a prescribed thickness on its surface, including zinc and aluminum components within a composition of the plated steel, that is used on the steel board for press molding at least a portion of the chassis. The highly durable alloy plated steel has an r-value (the plastic strain ratio=Lankford value) of 1.6 or more with an elongation value of 40% and more derived from the tensile test, for allowing an oil-free press molding process. In addition to that, the highly durable alloy plated steel has a coefficient of dynamic friction of the film coated surface which is not more than 0.17.

According to the outer casing of the outdoor unit of the air conditioner of the patent document 1, the plated portions have a good durability, and it can protect the design to the same extent as the sheet metal components that are coated. However, a steel base becomes exposed at a cut section of the sheet metal. There is a limitation in restraining occurrence of the rusts entirely. For example, the patent document 2 discusses the air conditioner that constructs external components of the air conditioner and inner components that directly contact the drain water, with a highly corrosion resistant hot-dipped Zn—Al—Mg plated steel board. This air conditioner forms a protective film on the exposed portions of the steel base. The corrosion of the steel base is prevented by formation of this coated film.

[Patent document 1] Japanese Patent No. 3702870

[Patent document 2] Japanese Published Patent Application No. 2004-69161

SUMMARY OF THE INVENTION

As discussed in the above patent documents 1 and 2, in recent years, a hot dipped Zn—Al plated steel board and a hot-dipped Zn—Al—Mg plated steel board are used for reducing a number of processing steps and improving the design. The hot dipped Zn—Al plated steel board and the hot-dipped Zn—Al—Mg plated steel board have an excellent corrosion resistance property against the external environment. However, Zn, Al, Mg and Fe (the steel base) used in plating, being less noble than copper, corrode due to the copper ions contained in the condensed water from a copper tube of the heat exchanger present inside the outdoor unit and a copper tube of the refrigerant pipe. As a result of this, there is a problem of progressing the corrosion of the baseboard.

When different metals in contact with one another are immersed into an electrolyte solution, since standard electrode potentials of the two metals are different, a potential difference occurs between the metal with a greater ionization potential (the base metal) and the metal with a lower ionization potential (the noble metal), a battery (the local battery, the Galvani's battery) is formed, and an electrical current (the local current) flows through, and an electric corrosion occurs. Such an electric corrosion occurring by electrochemical reaction due to a formation of the local battery having the two different metal electrodes is called a dissimilar metal contact corrosion/galvanic corrosion/local current corrosion.

The present invention, in attempt to solve the above-mentioned problems, is directed to an air conditioner capable of improving a resistance to corrosion of the outdoor unit.

According to one aspect of the present invention, an air conditioner for performing a cooling operation and a heating operation by switching a four side valve, that includes an outdoor side heat exchanger operating as a condenser during the cooling operation and an evaporator during the heating operation, and having fins and a heat transfer tube, wherein the outdoor side heat exchanger is placed on a baseboard that configures a lower portion of the chassis of the outdoor unit, which comprises the fins and the heat transfer tube of the outdoor side heat exchanger which are constructed with aluminum or aluminum alloy, and the baseboard which is constructed with the Zn—Al plated steel board or the Zn—Al—Mg plated steel board.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute apart of the specification, illustrate exemplary embodiments, features, and aspects of the invention and, together with the description, serve to explain the principles of the invention.

DESCRIPTION OF THE EXEMPLARY EMBODIMENTS

Various exemplary embodiments, features, and aspects of the present invention will now herein be described in detail with reference to the drawings. It is to be noted that the relative arrangement of the components, the numerical expressions, and numerical values set forth in these embodiments are not intended to limit the scope of the present invention unless it is specifically stated otherwise.

First Embodiment

Figure 1:
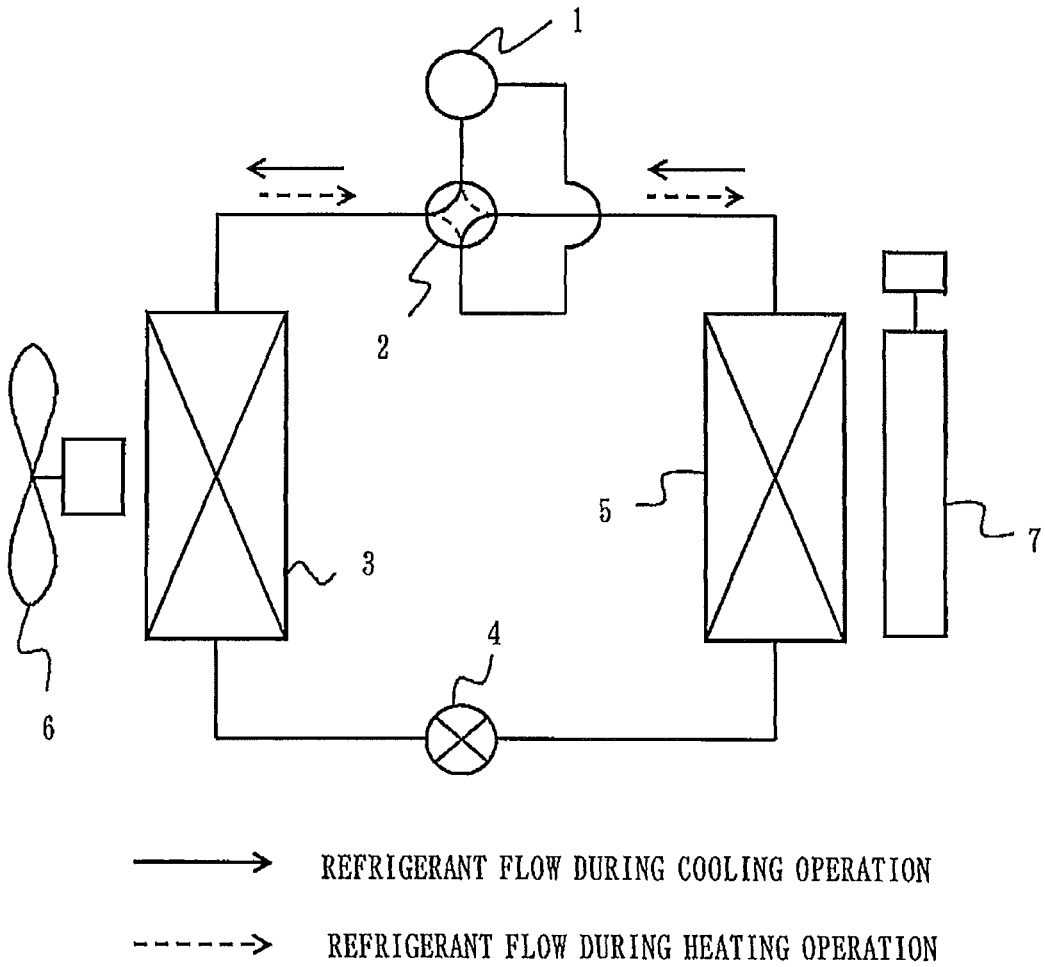
FIG. 1 is a refrigerant circuit diagram of the air conditioner, in accordance with a first embodiment.
Figure 2:
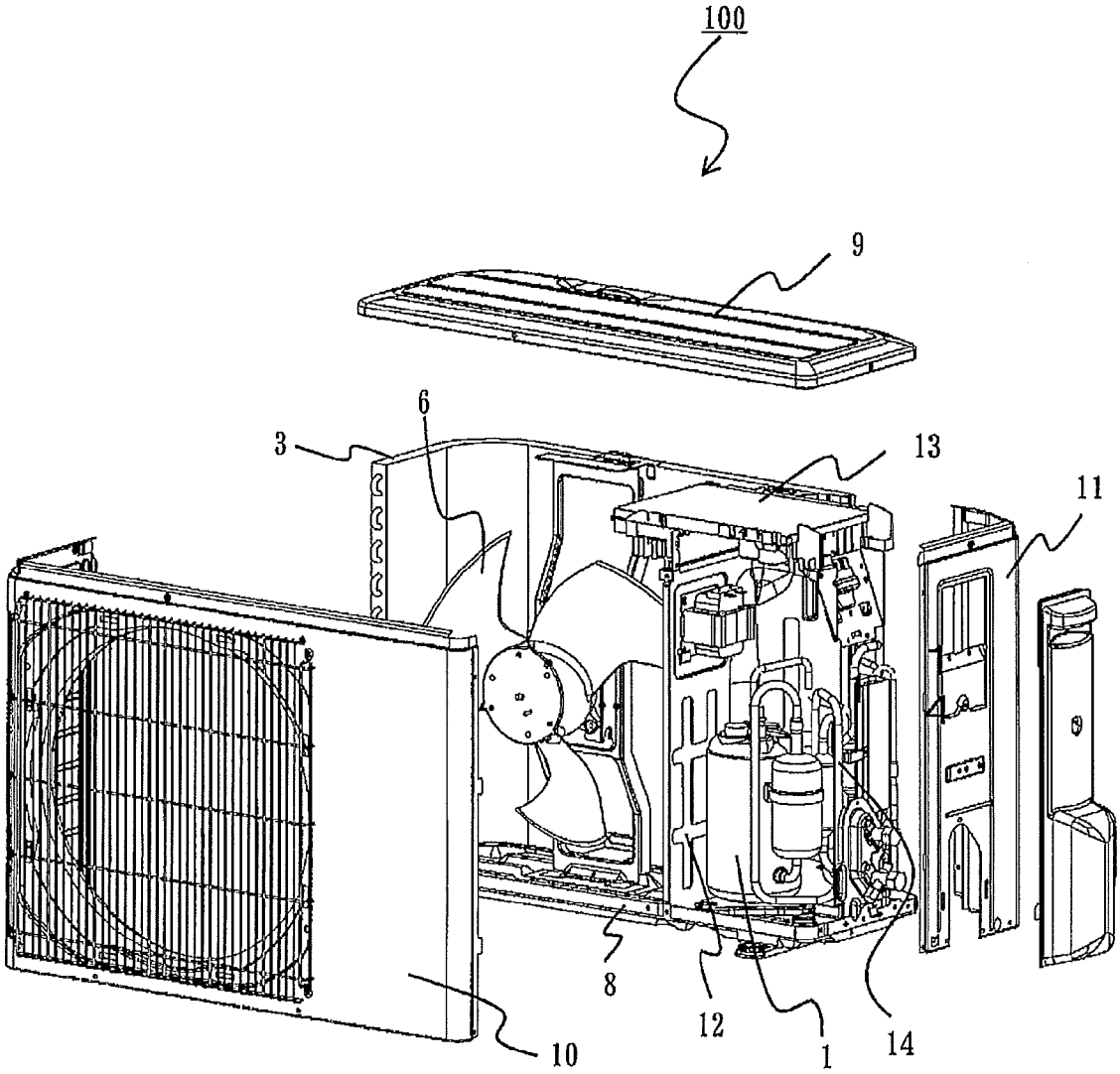
FIG. 2 is an exploded perspective view of an outdoor unit 100, in accordance with the first embodiment.
Figure 3:
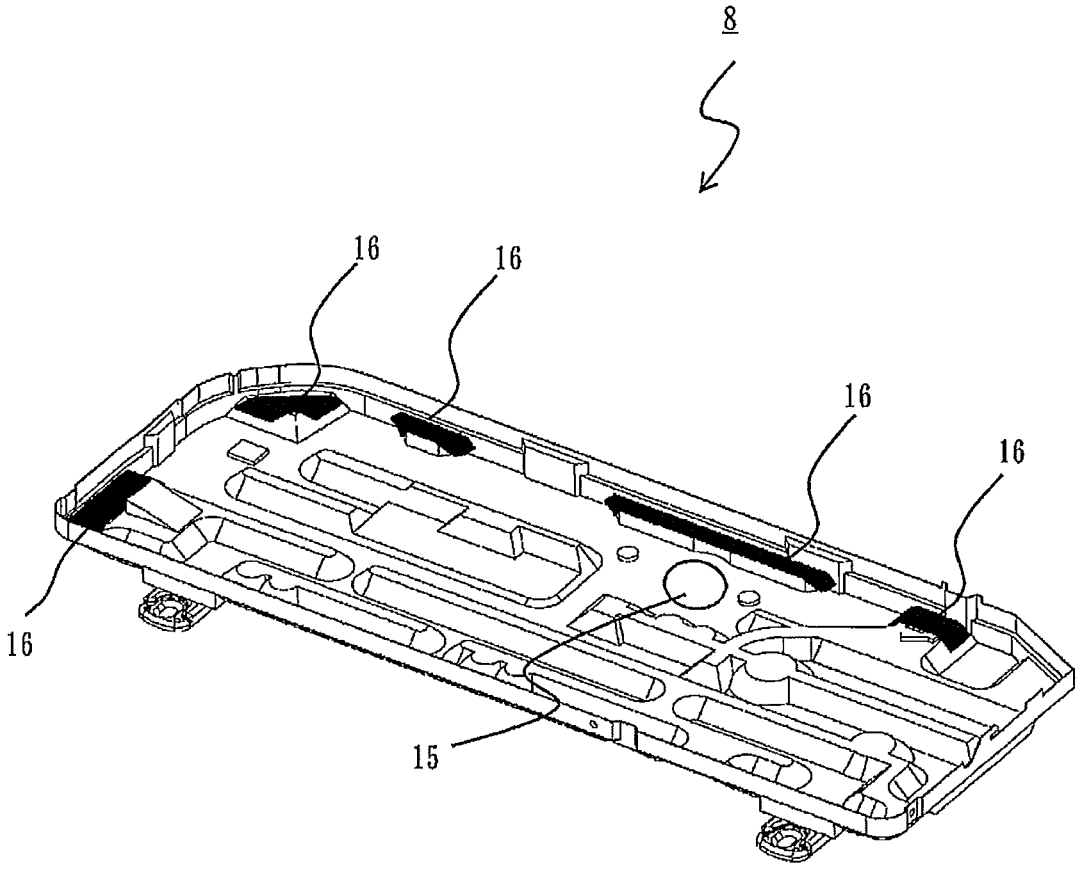
FIG. 3 is a perspective view of a baseboard 8 of the outdoor unit 100, in accordance with the first embodiment.
Figure 4:
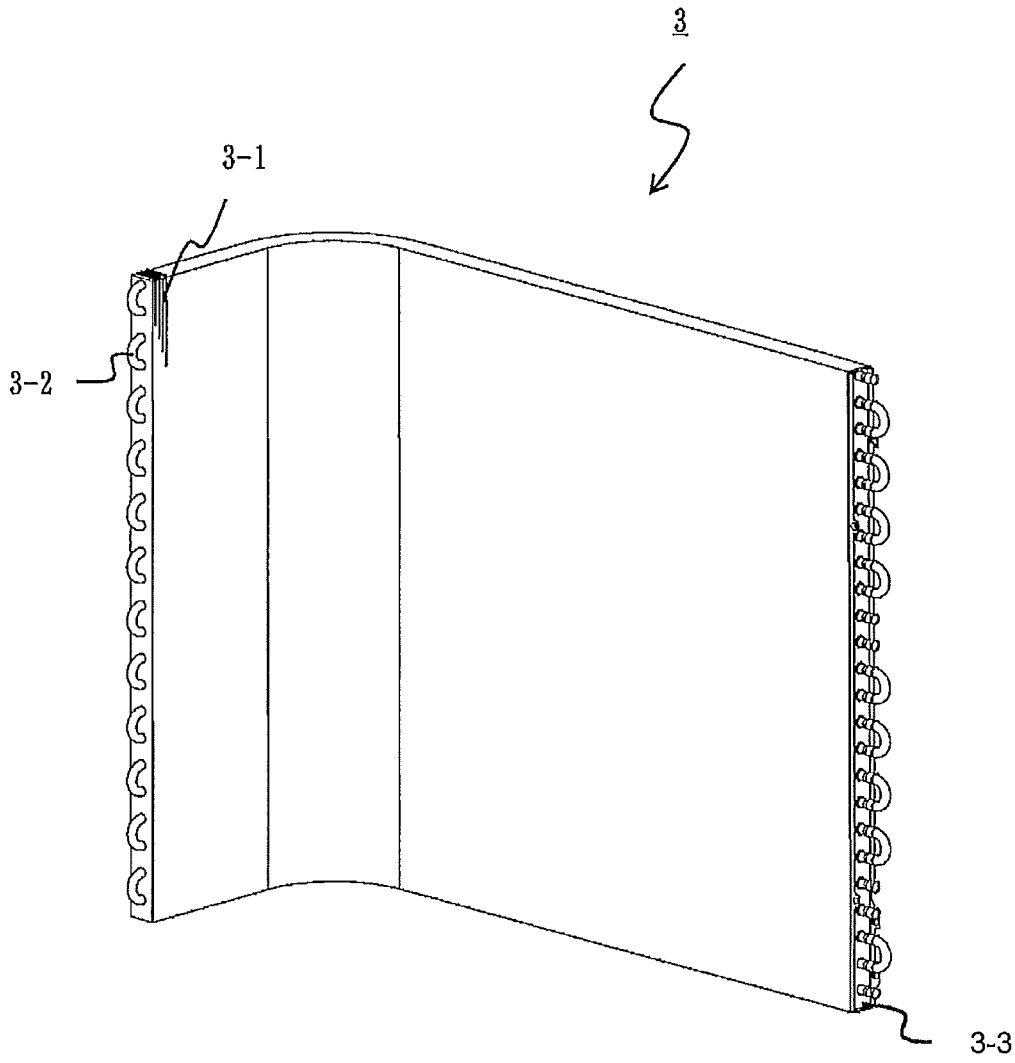
FIG. 4 is a perspective view of an outdoor side heat exchanger 3, in accordance with the first embodiment.
Figure 5:
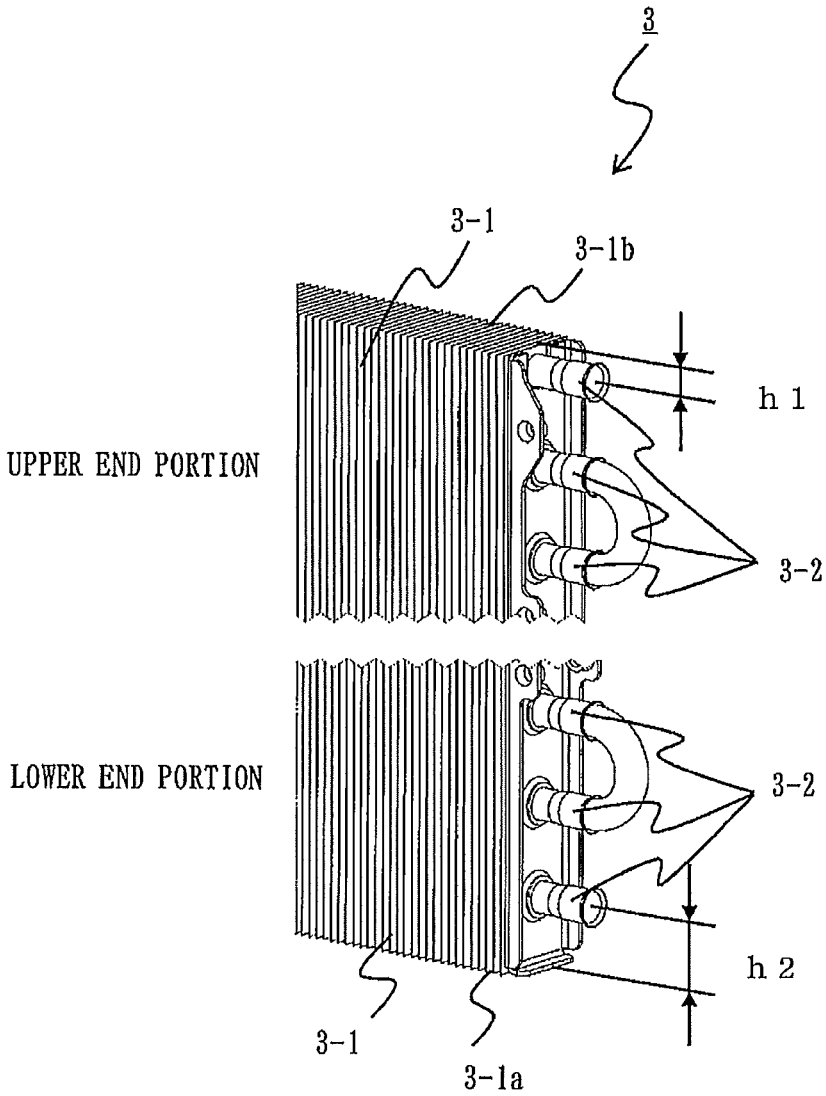
FIG. 5 is a partial enlarged view of the outdoor side heat exchanger 3, in accordance with the first embodiment.
Figure 6:
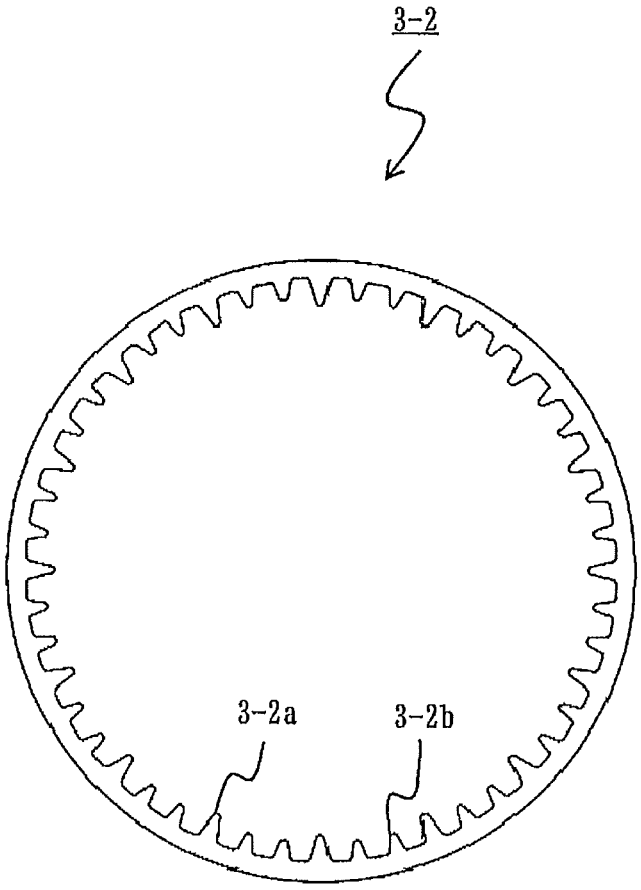
FIG. 6 is an enlarged sectional view of a heat transfer tube 3-2, in accordance with the first embodiment.
Figure 7:
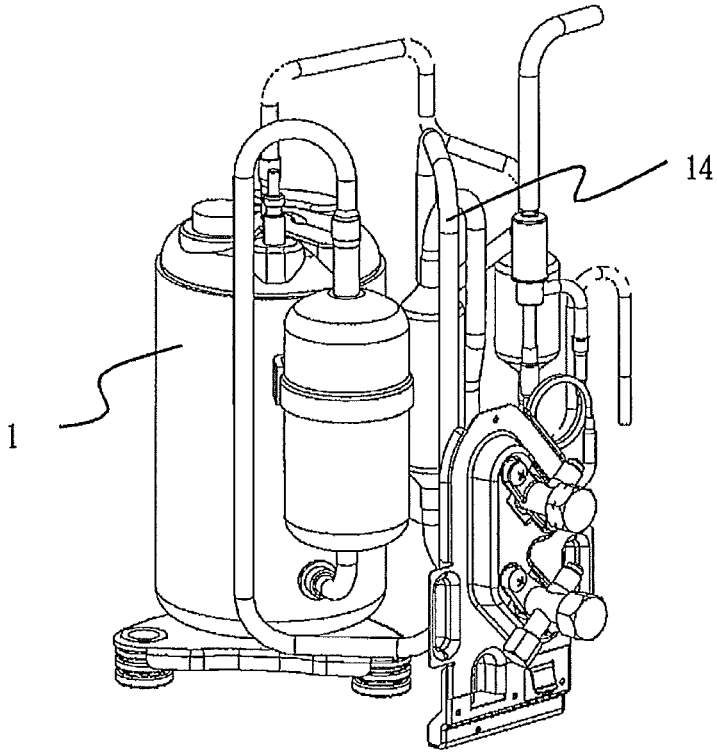
FIG. 7 is an enlarged view of refrigerant pipes/refrigerant cycle components 14 of the outdoor unit 100, in accordance with the first embodiment.
Figure 8:
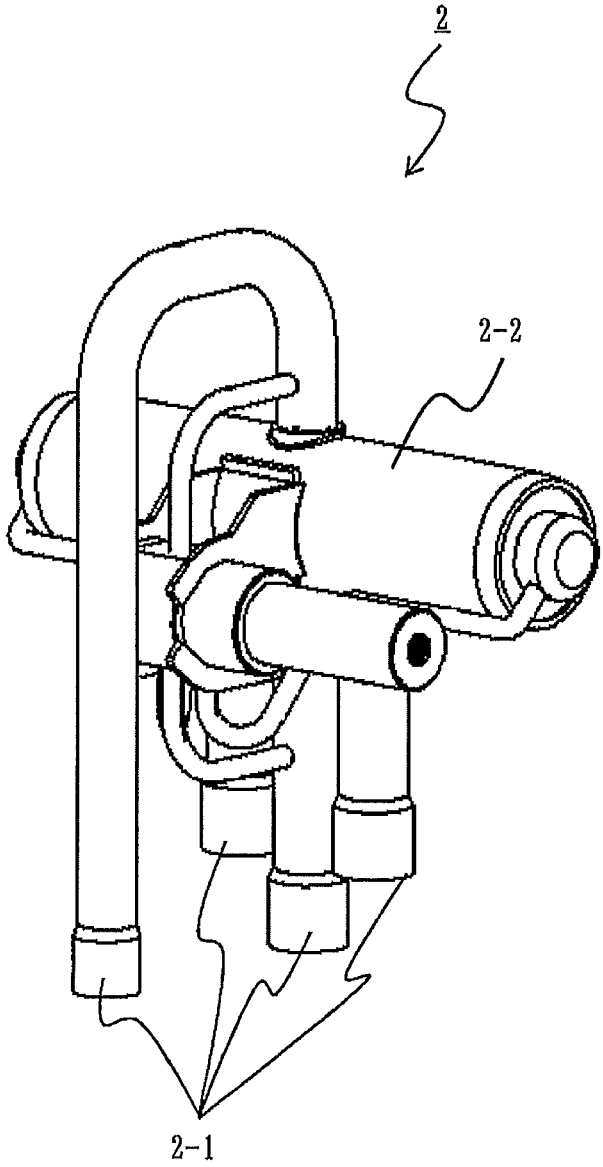
FIG. 8 is an enlarged view of a four side valve 2, in accordance with the first embodiment.
Figure 9:
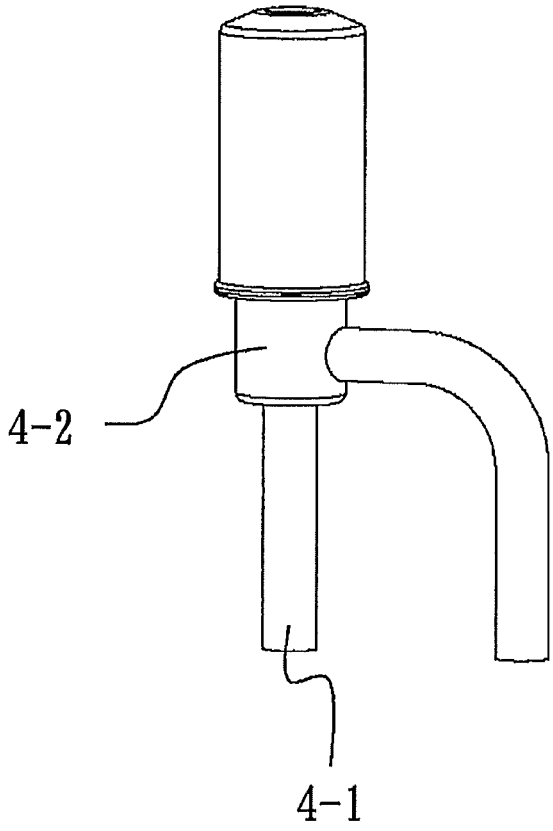
FIG. 9 is an enlarged view of a decompression device 4, in accordance with the first embodiment.
Figure 10:
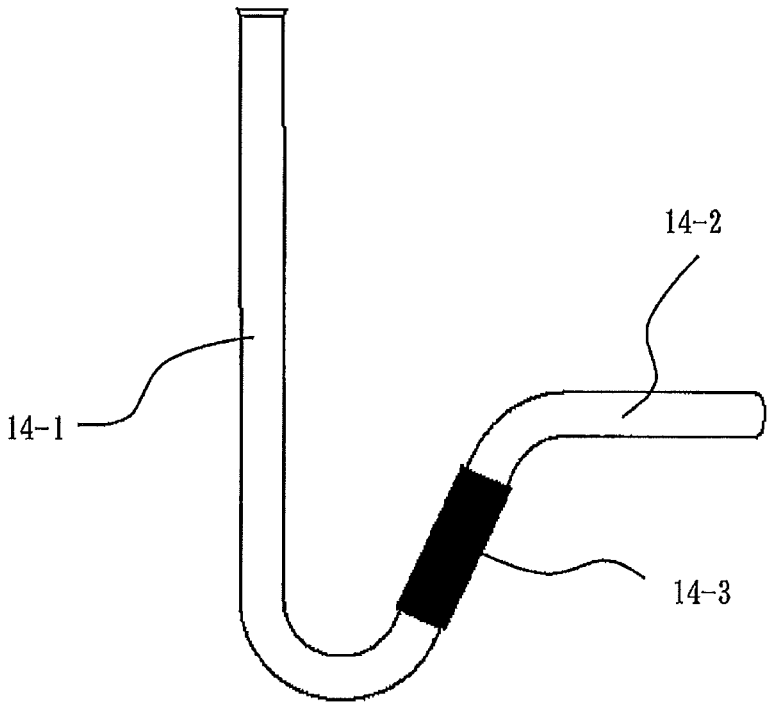
FIG. 10 is an enlarged view showing a joint between an aluminum tube 14-2 and a copper tube 14-1, in accordance with the first embodiment.
Figure 11:
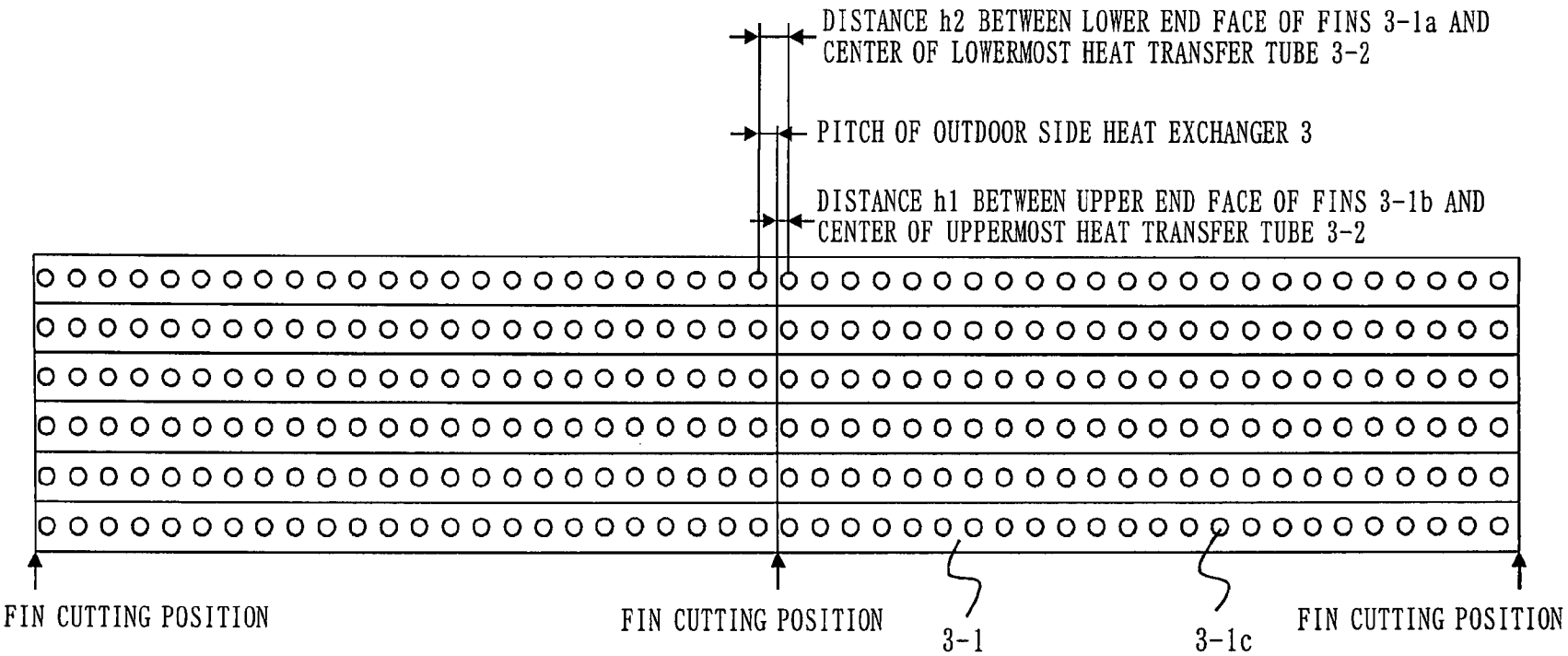
FIG. 11 illustrates a state of a fin 3-1 of the outdoor side heat exchanger 3 prior to cutting at the manufacturing stage.

FIGS. 1 to 11 illustrate the first embodiment. FIG. 1 is the refrigerant circuit diagram of the air conditioner. FIG. 2 is the exploded perspective view of the outdoor unit 100. FIG. 3 is the perspective view of the baseboard 8 of the outdoor unit 100. FIG. 4 is the perspective view of the outdoor side heat exchanger 3. FIG. 5 is the partial enlarged view of the outdoor side heat exchanger 3. FIG. 6 is the enlarged sectional view of the heat transfer tube 3-2. FIG. 7 is the enlarged view of the refrigerant pipes/refrigerant cycle components 14 of the outdoor unit 100. FIG. 8 is the enlarged view of the four side valve 2. FIG. 9 is the enlarged view of the decompression device 4. FIG. 10 is the enlarged view showing a joint between the aluminum tube 14-2 and the copper tube 14-1. FIG. 11 illustrates the state of the fin 3-1 of the outdoor side heat exchanger 3 prior to cutting at the manufacturing stage.

As shown in FIG. 1, the refrigerant circuit of the air conditioner comprises a compressor 1 that compresses the refrigerant, the four side valve 2 that switches between the refrigerant flow direction of the cooling operation and the refrigerant flow direction of the heating operation, the outdoor side heat exchanger 3 that operates as a condenser during the cooling operation and an evaporator during the heating operation, the decompression device 4 (the expansion electronic valve) that reduces a pressure of the high-pressure liquid refrigerant into a low-pressure gas-liquid two-phase refrigerant, and an indoor side heat exchanger 5 that operates as the evaporator during the cooling operation and the condenser during the heating operation. These are successively connected to configure a refrigerating cycle.

A solid-line arrow of FIG. 1 indicates a refrigerant flow direction during the cooling operation. A broken-line arrow on FIG. 1 indicates a refrigerant flow direction during the heating operation.

An outdoor side ventilation fan 6 is provided to the outdoor side heat exchanger 3, and an indoor side ventilation fan 7 (the cross-flow fan) is provided to the indoor side heat exchanger 5.

During the cooling operation, a compressed high-temperature and high-pressure refrigerant discharged from the compressor 1 flows into the outdoor side heat exchanger 3, via the four side valve 4. At the outdoor side heat exchanger 3, the outdoor air exchanges heat with the refrigerant while it passes through the fins and the tube (the heat transfer tube) of the outdoor side heat exchanger 3 by driving the outdoor side ventilation fan 6 provided on its airflow route. The refrigerant is cooled to become a high-pressure liquid phase, and the outdoor side heat exchanger 3 acts as the condenser. After that, the refrigerant reduces its pressure by passing through the decompression device 4, becomes a low-pressure gas-liquid two-phase refrigerant, and flows into the indoor side heat exchanger 5. At the indoor side heat exchanger 5, the indoor air exchanges heat with the refrigerant while it passes through the fins and the tube (the heat transfer tube) of the indoor side heat exchanger 5 by driving the indoor side ventilation fan 7 (the cross-flow fan) provided on its airflow route. The air blown out into the indoor space is cooled, on the other hand, the refrigerant that received the heat from the air is evaporated to become a gaseous state (the indoor side heat exchanger 5 acts as the evaporator), and the refrigerant returns to the compressor 1 after that. The indoor space is air conditioned (cooled) by the air cooled at the indoor side heat exchanger 5.

Also, during the heating operation, the four side valve 2 is reversed, so that the refrigerant flow direction during the heating operation is reversed during the cooling operation. The indoor side heat exchanger 5 acts as the condenser, and the outdoor side heat exchanger 3 acts as the evaporator. The indoor space is air conditioned (heated) by the air heated at the indoor side heat exchanger 5.

A configuration of the outdoor unit 100 of the air conditioner will be described with reference to FIG. 2. The outdoor unit 100 of the air conditioner comprises a roughly L-shaped outdoor side heat exchanger 3 in planer view, the baseboard 8 that constructs a base unit of the chassis of the outdoor unit 100, a flat-shaped top panel 9 that constructs a top face of the chassis, a roughly L-shaped front panel 10 in planer view that constructs a frontal face and a side of the chassis, a side panel 11 that constructs an opposite side of the chassis, a separator 12 that partitions the airflow route (a ventilation fan room) and a mechanical room, an electrical component box 13 that stores the electrical components, the compressor 1 that compresses the refrigerant, the refrigerant pipes/refrigerant circuit components 14 that form the refrigerant cycle, and the outdoor side ventilation fan 6 that performs a ventilation of the outdoor side heat exchanger 3.

FIG. 3 is the perspective view of the baseboard 8 (the base), viewed from an upper right corner. Zn—Al plated steel board or Zn—Al—Mg plated steel board are used as a steel board material of the baseboard 8. Moreover, a drain discharge port 15 is provided at a lower position of the outdoor side heat exchanger 3, for discharging the drains occurring at the outdoor side heat exchanger 3 and the like. There is a slope inclined towards the drain discharge port 15 for facilitating a drainage property. Further, a butyl rubber 16 (one example of the insulating material) is affixed to contact portions of the outdoor side heat exchanger 3 and the baseboard 8.

Further, a highly corrosion resistant Zn—Al—Mg plated steel board forming the baseboard 8 is a highly corrosion resistant hot-dipped plated steel board having a minute crystalline structure, of which has a plated layer composition of Zn—Al(6%)-Mg(3%).

FIG. 4 is the perspective view showing the outdoor side heat exchanger 3. The outdoor side heat exchanger 3 as used herein is a fin-and-tube type heat exchanger. The fin-and-tube type heat exchanger configures a refrigerant flow (the circuit) by bridging a multiplicity of hair pin tubes arranged in parallel and bent into a hairpin shape, with a multiplicity of return bend tubes bent into U-shape and inserted to end portions of the hair pin tubes. Then, a multiplicity of fins are arranged in parallel at a constant spacing on the outer surfaces of the hair pin tubes.

A hydrophilic film coated A1200 (the aluminum alloy) is used as a material of the fin 3-1.

1000 series aluminum alloys (such as A1070, A1050, A1100, and A1200) are called pure aluminums. These are the aluminums having a purity of 99.9% or more. These alloys are especially excellent in corrosion resistance, workability, weldability, luster, and conductivity, but their strengths are low, which becomes even lower as a purity level increases. Amount of impurities Fe and Si contained in this alloy influence the corrosion resistance property and the molding property. These alloys are categorized into the non heat treatable alloy.

Also, A3003 (the aluminum alloy) is used as a material of the heat transfer tube 3-2.

3000 series aluminum alloys (Al—Mn alloy such as A3003 and A3203) have improved their strengths by adding Mn but without losing the workability and the corrosion resistance property of the pure aluminums. The strength increases further by adding Mg. These alloys are categorized into the non heat treatable alloy.

Aluminum or aluminum alloy is used as the material of an outdoor side heat exchanger side board 3-3 which is arranged in parallel to the fin 3-1, at an end portion of the fins 3-1 of the outdoor side heat exchanger 3.

FIG. 5 is the enlarged view of the upper end and the lower end of the outdoor side heat exchanger 3. A distance h2 between a lower end face of the fins 3-1*a* and a center of the lowermost heat transfer tube 3-2 is greater than a distance h1 between an upper end face of the fins 3-1*b* and a center of the uppermost heat transfer tube 3-2. The reason for this will be described later.

FIG. 6 is the sectional view of the heat transfer tube 3-2. A zinc diffusion layer (one example of the sacrificial protection layer) is present throughout an outer circumference of the heat transfer tube 3-2. The amount of zinc attachment is 3 $g/m^2$ or more.

The heat transfer tube 3-2 at its inner periphery has an unevenness surface including two kinds of bulges, namely a high bulge part 3-2*a* and a low bulge part 3-2*b*. In the example of FIG. 6, a combination of a single high bulge part 3-2*a* and two low bulge parts 3-2*b* is repeatedly formed. It should be noted that this is only one example. The combination of the high bulge part 3-2*a* and the low bulge part 3-2*b* can be arbitrary.

In order to firmly adhere the fin 3-1 and the heat transfer tube 3-2, an extended tube ball (not illustrated), having a size greater than an inner diameter of the heat transfer tube 3-2, is inserted inside the heat transfer tube 3-2 for attempting a mechanical expansion of the tube. At this time, the high bulge parts 3-2*a* and the low bulge parts 3-2*b* are squashed. A3003 (the aluminum alloy) having a relatively high strength is used as a material forming the heat transfer tube 3-2, to avoid squashing of the high bulge parts 3-2*a* and the low bulge parts 3-2*b*.

By configuring with the two kinds of bulges, the high bulge parts 3-2*a* and the low bulge parts 3-2*b*, only the high bulge parts 3-2*a* are squashed, and the low bulge parts 3-2*b* can maintain the same original shape as before the tube expansion, thereby restraining a decline in the performance of the heat transfer tube 3-2 caused by decreased inner peripheral surface area.

Accordingly, a number of the low bulge parts 3-2*b* is preferably more than a number of the high bulge parts 3-2*a*. However, the number of the low bulge parts 3-2*b* may be less than the number of the high bulge parts 3-2*a*.

FIG. 7 is the perspective view (including the compressor 1) showing the refrigerant pipes/refrigerant circuit components 14. Aluminum or aluminum alloy is used to a part or all of the refrigerant pipes. In order to construct the refrigerant pipes with aluminum or aluminum alloy entirely, aluminum or aluminum alloy should also be used at the joints of the refrigerant circuit components.

FIG. 8 is the perspective view of the four side valve 2. Aluminum or aluminum alloy is used for joints 2-1. Stainless steel is used in a main body unit 2-2.

FIG. 9 is the perspective view of the decompression device 4 (the expansion electronic valve). Aluminum or aluminum alloy is used for a joint 4-1. Stainless steel is used in a main body unit 4-2. When a portion of the refrigerant tube is made of aluminum or aluminum alloy, there is going to be a joint between aluminum or aluminum alloy and the copper tube.

FIG. 10 is the enlarged view of the joint between the aluminum tube and the copper tube. Referring to FIG. 10, the joint between the copper tube 14-1 and the aluminum tube 14-2 is covered by a heat contraction tube 14-3.

The copper tube 14-1 and the aluminum tube 14-2 are connected by an eutectic bonding which is well known. Also, the joint is covered by the heat contraction tube 14-3. An inner surface of the heat contraction tube 14-3 is plastered with an adhesive that melts upon heating.

There is a combination of dissimilar metals (alloys), with a predetermined composition, having a characteristic that causes a phenomenon called an eutectic reaction. The melting point of an alloy causing the eutectic reaction is lower than the melting point of a pure metal constituting the alloy. When Al and Cu showing the eutectic reaction are heated by exerting a contact pressure, an inter diffusion is accelerated and an Al—Cu alloy layer is formed near a contact portion. When continues to elevate a temperature by heating, the alloy portion starts to melt before the melting of parent materials, namely, Cu and Al. The melted substance is immediately discharged from a contact surface by applying a pressure. When heating and melting stop after a prescribed time, a joint that include a two-metal alloy layer appears on a contact face. Selective melting occurring only at the contact portion of the dissimilar metals causing the eutectic reaction as such is called the eutectic bonding. The heating method includes the resistance heating method that utilize a contact resistance of the dissimilar metals and the high frequency induction heating method.

Since the inner surface of the heat contraction tube 14-3 is plastered with the adhesive that melts upon heating, when the heat contraction tube 14-3 is heated, the heat contraction tube 14-3 is adhered to the joint between the copper tube 14-1 and the aluminum tube 14-2, thereby preventing an intrusion of the condensed water.

Also, owing to the eutectic bonding of the copper tube 14-2 and the aluminum tube 14-2, the dissimilar metal contact corrosion of the copper and the aluminum does not occur.

Moreover, a lower end of the pipe is the copper tube 14-1 in order that the condensed water from the copper tube 14-1 to not transmit to the aluminum tube 14-2, thereby preventing the corrosion of aluminum tube 14-2 caused by the copper ions.

Hereinbelow, an influence/effect of the first embodiment will be described. When the baseboard 8 is constructed with Zn—Al plated steel board or Zn—Al—Mg plated steel board, the copper ions contained in the condensed water from the copper tube of the outdoor side heat exchanger 3 and the copper tube 14-1 of the refrigerant pipes/refrigerant circuit components 14 inside the outdoor unit 100, cause the electric corrosion of Zn, Al, Mg, and Fe (the steel base) used in the steel, since these metals are less noble than copper, thereby accelerating the corrosion of the baseboard 8.

Thus, in the first embodiment, aluminum or aluminum alloy which is less noble than copper is used as the material for forming the heat transfer tube 3-2 of the outdoor side heat exchanger 3, and since the copper ions will not be contained in the condensed water of the outdoor side heat exchanger 3, the corrosion can be restrained even if the condensed water of the outdoor side heat exchanger 3 comes into contact with the baseboard 8.

Furthermore, an amount of the copper ions is decreased when aluminum or aluminum alloy is used for a portion or all of the refrigerant pipes/refrigerant circuit components 14, thereby effectively restraining the corrosion of the baseboard 8.

Furthermore, the amount of copper ions is decreased when aluminum or aluminum alloy is used for the joint of the refrigerant circuit components, namely the four side valve 2 and the decompression device 4 (the expansion electronic valve), thereby effectively restraining the corrosion of the baseboard 8.

The corrosion of the aluminum pipe itself is prevented when the zinc diffusion layer, being less noble than aluminum, (one example of the sacrificial protection layer) is formed on an outer circumference of the heat transfer tube 3-2, thereby effectively improving a reliability of the outdoor side heat exchanger 3 against the corrosion.

Conventionally, an iron is used as a material forming the outdoor side heat exchanger side plate 3-3. In the first embodiment, the same metal, aluminum or aluminum alloy, is used for the heat transfer tube 3-2, there by preventing the dissimilar metal contact corrosion.

The butyl rubber 16 is affixed to the portions on the baseboard 8 (the base) where the outdoor side heat exchanger 3 comes into contact with the baseboard 8. In this way, the dissimilar metal contact corrosion is prevented by electrically insulating the outdoor side heat exchanger 3 and the baseboard 8, thereby effectively providing the outdoor unit 100 having a high reliability against the corrosion.

The butyl rubber 16 is affixed to the portions on the baseboard 8 (the base) where the outdoor side heat exchanger 3 comes into contact with the baseboard 8 (see FIG. 3). In this way, the dissimilar metal contact corrosion is prevented by electrically insulating the outdoor side heat exchanger 3 and the baseboard 8, thereby effectively providing the outdoor unit 100 having a high reliability against the corrosion.

Thus, the lowermost heat transfer tube 3-2 of the outdoor side heat exchanger 3, as shown in FIG. 5, for example, the distance h2 between the lower end face of fins 3-1*a* and the center of lowermost heat transfer tube 3-2 is greater than the distance h1 between the upper end face of fins 3-1*b* and the center of uppermost heat transfer tube 3-2.

The heat transfer tube 3-2 is resistant against the corrosion longer when a duration of the lowermost heat transfer tube 3-2 being immersed under the drain water which is accumulated on the baseboard 8 shortens by separating the lowermost heat transfer tube 3-2 of the outdoor side heat exchanger 3 from the baseboard 8.

FIG. 11 illustrates the fin 3-1 used in the outdoor side heat exchanger 3. A rolled aluminum sheet is punched by pressing. A plural number (several tens) of the holes 3-1*c* used for inserting the heat transfer tube 3-2 are punched all at once (FIG. 11 illustrates 6 holes only, but there are several tens of holes in the actual practice). The next holes 3-1*c* are punched in a likewise manner by moving the aluminum sheet at the same pitch interval. The aluminum sheet removed from the press machine is cut into units divided at a position indicated by a solid line of FIG. 11. Accordingly, by way of illustration of FIG. 11, 12 sheets of the fins 3-1 are cut from a single aluminum sheet, having punched the holes 3-1*c*.

A predetermined number of the fins 3-1 that are cut are stacked, the heat transfer tube 3-2 is inserted to the holes 3-1*c* of the fins 3-1, and the outdoor side heat exchanger 3 is produced accordingly.

The fin cutting position, in the moving direction of the rolled aluminum sheet, as shown in FIG. 11, is not a center between the holes 3-1*c*, but is slightly offset from the center.

This is the reason why the distance h2 between the lower end face of fins 3-1*a* and the center of lowermost heat transfer tube 3-2 should be made greater than the distance h1 between the upper end face of fins 3-1*b* and the center of uppermost heat transfer tube 3-2.

The holes 3-1*c* used in the outdoor side heat exchanger 3, for inserting the heat transfer tubes 3-2, are punched by the press machine at the same pitch interval on the fins 3-1, so that in order to make the distance h2 between the lower end face of fins 3-1*a* and the center of lowermost heat transfer tube 3-2 greater, the only method available is to be h2>h1 under the limited condition of h2+h1=pitch interval.

A center of the heat transfer tube 3-2 is identical with a center of the hole 3-1*c*.

The pitch interval of the outdoor side heat exchanger 3 shown in FIG. 11 is constant. The pitch interval of the outdoor side heat exchanger 3=(the distance between the lower end face of fins 3-1*a* and the center of lowermost heat transfer tube 3-2)+(the distance between the upper end face of fins 3-1*b* and the center of uppermost heat transfer tube 3-2). For example, a highly reliable outdoor unit 100 resistant against the corrosion can be provided by making the distance h2 between the lower end face of fins 3-1*a* and the center of lowermost heat transfer tube 3-2 greater than the distance h1 between the upper end face of fins 3-1*b* and the center of uppermost heat transfer tube 3-2.

The drain discharge port 15 is provided on the baseboard 8 for discharging the drain water. The baseboard 9 is inclined towards the drain discharge port for facilitating the discharging property (see FIG. 3). The amount of copper ions accumulating in the baseboard 8 is reduced by improving the discharge property, thereby improving the reliability against the corrosion.

As described above, in the present embodiment, aluminum or aluminum alloy is used, which is less noble than copper, as the material of the heat transfer tube 3-2 of the outdoor side heat exchanger 3, and because the copper ions will not be contained in the condensed water of the outdoor side heat exchanger 3, the corrosion can be restrained even if the condensed water of the outdoor side heat exchanger 3 comes into contact with the baseboard 8.

Also, the amount of copper ions can be decreased by using aluminum or aluminum alloy for a part or all of the refrigerant pipes/refrigerant circuit components 14, thereby effectively restraining the corrosion of the baseboard 8.

Also, the amount of copper ions can be decreased by using aluminum or aluminum alloy for the joints of the four side valve 2 and the decompression device 4, which are the refrigerant circuit components, thereby effectively restraining the corrosion of the baseboard 8.

Moreover, the corrosion of the aluminum pipe itself is prevented by providing the zinc diffusion layer, zinc being less noble than aluminum, (one example of the sacrificial protection layer) to the outer circumference of the heat transfer tube 3-2, thereby improving the reliability of the outdoor side heat exchanger 3 against the corrosion.

Moreover, the iron is used conventionally as the material of the outdoor side heat exchanger side board 3-3, but in the present embodiment, aluminum or aluminum alloy is used, and the dissimilar metal contact corrosion is prevented by using the same metal as the heat transfer tube 3-2.

Moreover, the butyl rubber 16 is affixed to the portions on the baseboard 8 (the base) where the outdoor side heat exchanger 3 comes in contact with the baseboard 8 and the outdoor side heat exchanger 3 and the baseboard 8 is electrically insulated. In this way, the dissimilar metal contact corrosion is prevented, thereby providing the outdoor unit 100 having the high reliability against the corrosion.

Furthermore, the lowermost heat transfer tube 3-2 of the outdoor side heat exchanger 3, the distance h2 between the lower end face of fins 3-1*a* and the center of lowermost heat transfer tube 3-2 is greater than the distance h1 between the upper end face of fins 3-1*b* and the center of uppermost heat transfer tube 3-2. The heat transfer tube 3-2 is resistant against the corrosion longer when a duration of the lowermost heat transfer tube 3-2 being immersed under the drain water which is accumulated on the baseboard 8 shortens by separating the lowermost heat transfer tube 3-2 of the outdoor side heat exchanger 3 from the baseboard 8.

The air conditioner of the present invention produces the effect of improving the resistance to corrosion of the outdoor unit because the aluminum or the aluminum alloy is used to construct the fins and the heat transfer tube of the outdoor side heat exchanger, and the Zn—Al plated steel or the Zn—Al—Mg plated steel is used to construct the baseboard.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. An air conditioner for performing a cooling operation and a heating operation by switching a four side valve, that includes an outdoor side heat exchanger operating as a condenser during the cooling operation and an evaporator during the heating operation, and having fins and a plurality of heat transfer tubes, wherein the outdoor side heat exchanger is placed on a baseboard that configures a lower portion of a chassis of the outdoor unit, comprising:

the fins and the heat transfer tubes of the outdoor side heat exchanger constructed with aluminum or aluminum alloy; and the baseboard constructed with Zn—Al plated steel board or Zn—Al—Mg plated steel board;

wherein the outdoor side heat exchanger has a distance between a lower end face of the fins and a center of a lowermost heat transfer tube of the outdoor side heat exchanger which is greater than a distance between an upper end face of the fins and a center of an uppermost heat transfer tube of the outdoor side heat exchanger, and wherein each interval between centers of heat transfer tubes adjacent to each other of the outdoor side heat exchanger is equivalent to a sum of the distance between the lower end face of the fins and the center of the lowermost heat transfer tube of the outdoor side heat exchanger, and the distance between the upper end face of the fins and the center of the uppermost heat transfer tube of the outdoor side heat exchanger.

2. The air conditioner according to claim 1, comprising:

a zinc sacrificial protection layer provided throughout an outer circumference of the heat transfer tubes of the outdoor side heat exchanger.

3. The air conditioner according to claim 1, wherein the outdoor unit includes a refrigerant pipe which is partially or totally constructed with aluminum or aluminum alloy.

4. The air conditioner according to claim 1, wherein the outdoor side heat exchanger includes an outdoor side heat exchanger side board, wherein the outdoor side heat exchanger side board is constructed with aluminum or aluminum alloy.

5. The air conditioner according to claim 1, wherein the four side valve at its joint is constructed with aluminum or aluminum alloy.

6. The air conditioner according to claim 1, wherein the outdoor unit includes a decompression device serving as a refrigerant circuit component, and wherein the decompression device at its joint is constructed with aluminum or aluminum alloy.

7. The air conditioner according to claim 1, further comprising:

an insulating material installed between the outdoor side heat exchanger and the baseboard.

8. The air conditioner according to claim 1, wherein the baseboard provides a drain discharge port and has an inclination lowering towards the drain discharge port.

9. The air conditioner according to claim 1, wherein the plated steel board comprises Zn—Al (6%) and Mg (3%).

10. The air conditioner according to claim 1, wherein an inner periphery of the heat transfer tubes includes at least one high bulge part and at least two low bulge parts.

* * * * *